United States Patent [19]

Murakami et al.

[11] 4,181,539

[45] Jan. 1, 1980

[54] PROCESS OF PHOSPHATING AN IRON SUBSTRATE IN A CLOSED SYSTEM USING AROMATIC NITRO COMPOUND ACCELERATORS

[75] Inventors: Ryoichi Murakami, Kyoto; Yukio Anegawa; Minoru Ishida, both of Sakai; Keizi Masada, Toyonaka, all of Japan

[73] Assignee: Nippon Paint Co., Ltd., Japan

[21] Appl. No.: 905,177

[22] Filed: May 10, 1978

[30] Foreign Application Priority Data

May 11, 1977 [JP] Japan ..... 52-54720

[51] Int. Cl.[2] ..... C23F 7/10

[52] U.S. Cl. ..... 148/6.15 R; 148/6.17

[58] Field of Search ..... 148/6.15 R, 6.17

[56] References Cited

U.S. PATENT DOCUMENTS

| | | | |
|---|---|---|---|
| 2,657,156 | 10/1953 | Hyams et al. | 148/6.17 X |
| 3,272,664 | 9/1966 | Schlossberg et al. | 148/6.15 R |
| 3,906,895 | 9/1975 | Morino et al. | 148/6.14 R |
| 4,017,335 | 4/1977 | Maloney | 148/6.15 R |

*Primary Examiner*—Ralph S. Kendall

*Attorney, Agent, or Firm*—Wenderoth, Lind & Ponack

[57] ABSTRACT

A process for iron phosphating the surface of an iron substrate which comprises treating said surface with a phosphating solution comprising at least one of alkali metal and ammonium phosphates and at least one of aromatic nitro compounds as a phosphating accelerator in an aqueous medium and having a pH of about 3 to 6.5 in a closed system phosphating installation.

7 Claims, 2 Drawing Figures

Figure 1:
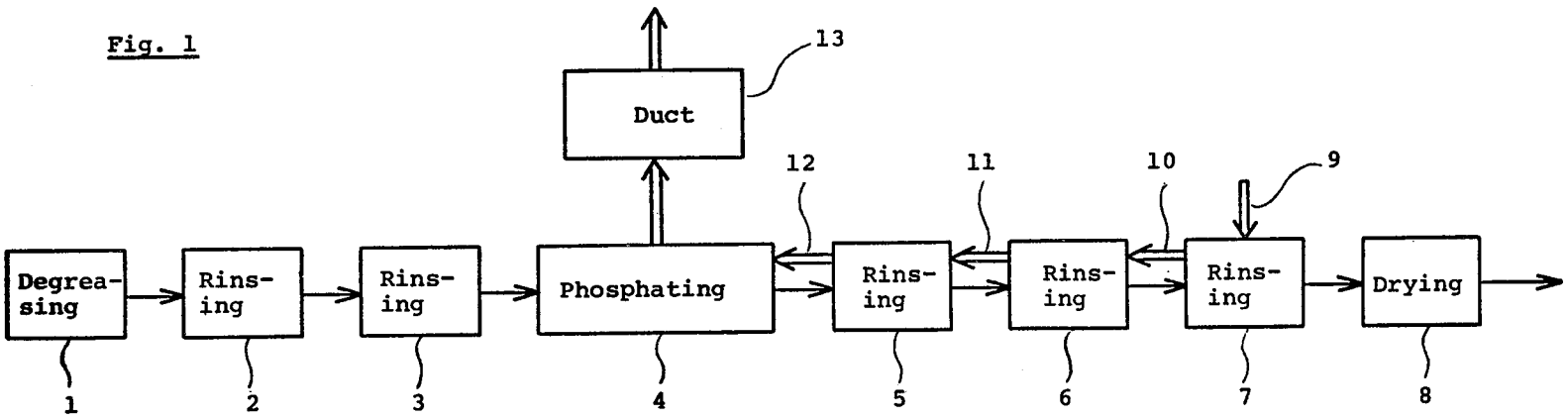

PROCESS OF PHOSPHATING AN IRON SUBSTRATE IN A CLOSED SYSTEM USING AROMATIC NITRO COMPOUND ACCELERATORS

The present invention relates to a phosphating process of an iron substrate. More particularly, it relates to a process for phosphating the surface of an iron substrate with a certain phosphating solution in a closed system phosphating installation.

Among various under-coating treatments of an iron substrate, phosphating has been widely adopted, since it enhances the resistance of the iron substrate to corrosion and improves the adhesion of a coating film applied onto the iron substrate.

In phosphating, there are included iron phosphate film formation and zinc phosphate film formation. Zinc phosphate film formation (i.e. zinc phosphating) is usually applied to motorcar bodies, electric goods for domestic use (e.g. washing machines, refrigerators), etc. In comparison with a zinc phosphate film, an iron phosphate film is somewhat inferior in corrosion resistance but has the following advantages: (a) the control of the phosphating solution bath is easier; (b) heavy metal ions are not included in the waste liquor, and special care is not needed in treatment of the waste liquor; (c) the phosphating solution has a relatively high pH, and an expensive material such as stainless steel is not needed for the construction of the apparatus, etc. Therefore, iron phosphate film formation (i.e. iron phosphating) is still widely applied to articles which are not required to have a high corrosion resistance such as parts of small products, accessories for agricultural materials and the like.

Typically, the process of iron phosphating comprises the stages of degreasing, rinsing, phosphating, rinsing and drying in this order. Sometimes, any of the said stages is omitted or combined. For instance, the iron phosphating process may also comprise the stages of phosphating (with degreasing), rinsing and drying. Each of the said stages can be carried out in a single step or plural steps.

At the stage of phosphating in those conventional iron phosphating processes, the deficiency of the phosphating solution caused by the drag-out or take-out with the iron substrate is eliminated usually by supplying a fresh phosphating solution so as to keep substantially constant the total acidity, the pH, the accelerator ion concentration, etc. in the phosphating solution.

At the rinsing stage, the degreasing solution or the phosphating solution adhering to the iron substrate is washed out, and simultaneously fresh water is always supplied to keep clean the tank(s) where rinsing is carried out. As the result, unclean water is always removed as overflow from the tank(s) and, after appropriate treatment, discarded from the installation.

In recent years, however, strong demands have been made to prevent environmental pollution as well as to save materials and sources. From this viewpoint, much attention has become drawn to a closed system where the production of waste liquor is substantially avoided and the considerably amounts of a phosphating solution and a rinsing water are saved. One of an example of such installation is the one as disclosed in U.S. Pat. No. 3,906,895.

For the iron phosphating process, there have been used various phosphating solutions, of which examples are aqueous solutions containing solely alkali metal or ammonium phosphates, aqueous solutions containing alkali metal or ammonium phosphates with surfactants, aqueous solutions containing alkali metal or ammonium phosphates and phosphating accelerators (e.g. molybdates, tungstates, chlorates, bromates, hydroxyamine salts) with or without surfactants, etc. These conventional phosphating solutions function normally at the initial stage but, when used continuously for a long period of time, results in accumulation of ions of decomposed products such as chlorine ion in case of using sodium chlorate as a phosphating accelerator and of soluble iron phosphate ($Fe(H_2PO_4)_2$), whereby yellow rust, powdery coating and other unfavorable defects are produced in the resulting phosphate film. Particularly when the iron phosphating process is carried out in an installation of closed system, as stated above, where a number of rinsing tanks are provided for prevention of accumulation of miscellaneous ions inhibiting the formation of a phosphate film and of contamination of the rinsing water at the final rinsing step with such miscellaneous ions, the said tendency to defective phosphating is much increased. For preventing the said defect, the incorporation of iron chelating agent into the phosphating solution has been proposed, but its effect can not be maintained for a long period of time. Further, the said proposal sometimes rather causes the increase of iron ion, and the firm adhesion between the iron substrate and the coating film provided thereon is not assured.

In order to overcome the said problems in conventional iron phosphating processes and for providing a phosphating solution suitable for the use in an installation of a closed system for iron phosphating, an extensive study has been carried out. As the result, it has now been found that an aqueous solution comprising at least one of alkali metal and ammonium salts and at least one of aromatic nitro compounds as a phosphating accelerator and being adjusted its pH within a certain specific range is quite suitable for the said purpose. Thus, the use of such aqueous solution as a phosphating solution does not result in accumulation of harmful ions (e.g. halogen ion, iron ion) to phosphating even when continuously employed in an installation of closed system and therefore assures (and rather enhances) the good adhesion between the iron substrate and the coating film provided thereon and the high resistance of the iron substrate to corrosion. Advantageously, such defective phosphating as powdery coating is not caused in spite of using no iron chelating agent therein. This invention is based on the above findings.

According to the present invention, there is provided a process for iron phosphating of an iron substrate by treatment of the iron substrate with a phosphating solution in an installation of closed system, characterized in that the phosphating solution is an aqueous solution comprising at least one alkali metal or ammonium phosphate and at least one aromatic nitro compound as a phosphating accelerator and having a pH of about 3 to 6.5.

The phosphating solution used in the present invention comprises as the essential components at least one of alkali metal and ammonium phosphates and at least one of aromatic nitro compounds. The term "alkali metal phosphates" includes $Me_3PO_4$ but also $Me_2HPO_4$ and $MeH_2PO_4$ wherein Me is an alkali metal (e.g. sodium, potassium). Likewise, the term "ammonium phosphates" includes not only $(NH_4)_3PO_4$ but also $(NH_4)_2HPO_4$ and $(NH_4)H_2PO_4$. Examples of the aromatic nitro compound as the phosphating accelerator are m-nitrobenzenesulfonates (e.g. sodium m-nitrobenzenesulfonate), nitrobenzoic acid, nitroresorcinol, etc. Among them, the use of m-nitrobenzenesulfonates is the most preferable, because it is the most effective in prevention of the accumulation of iron ion in the phosphating solution.

For the phosphating solution, it is essential to have a certain value of pH. Thus, the pH is required to be from about 3 to 6.5, preferably from about 5 to 6. When the pH is less than 3, the iron substrate is excessively etched on the phosphating so that powdery coating is apt to be produced. When the pH is more than 6.5, the phosphating is effected only to a small extent so that the desired performance is not sufficiently obtained.

The amounts of the alkali metal or ammonium phosphate and of the aromatic nitro compound may be decided appropriately depending on the pH value and the desired performance. The alkali metal or ammonium phosphate is used usually in an amount of about 1 to 15 g (calculated in terms of phosphate ion ($P_2O_5$))/liter, preferably in an amount of about 2 to 12 g/liter. The usual amount of the aromatic nitro compound is from about 0.05 to 5 g/liter, and the preferred amount is from about 0.2 to 2 g/liter. When the aromatic nitro compound is used in a lesser amount than the said lower limit, no acceleration effect is produced. Even if it is used in a larger amount than the said upper limit, no particular advantage is realized.

The phosphating solution of the invention may comprise additionally any conventional non-ionic or anionic surfactant. Examples of the non-ionic surfactant are polyoxyethylene alkyl ether, polyoxyethylene alkylphenol ether, polyoxyethylene fatty acid ester, etc. Examples of the antionic surfactant are sulfuric esters of fatty acid amides. These surfactants may be used normally in an amount of about 0.01 to 1.5 g/liter. The inclusion of those surfactants is meritorious in accomplishing degreasing and phosphating in a single stage.

The total acidity of the phosphating solution may be usually from about 2 to 30 (points), preferably from about 3 to 10. When the total acidity is less than about 2, sufficient phosphating can not be accomplished. When it is more than 30, no particular advantage is realized.

As hereinabove explained, the phosphating solution of the invention is especially useful for iron phosphating the surface of an iron substrate in an installation of closed system. The installation may be conventional insofar as it is of closed system. The installation as disclosed in U.S. Pat. No. 3,906,895 is a typical example of such installation, and the phosphating solution of the invention is favorably applicable thereto.

The term "iron substrate" may be construed to mean a substrate mainly constituted with iron. Therefore, a substrate made of steel is to be included in the category of the said term.

Other conditions for treatments including phosphating may be effected in per se conventional manners. For instance, the temperature at the phosphating stage is usually from about 40° to 70° C., preferably from about 40° to 55° C. Further, the time for phosphating treatment may be from a period of about 30 seconds to 10 minutes. Furthermore, the application of the phosphating solution may be effected in a spraying manner or in a dipping manner.

Figure 2:
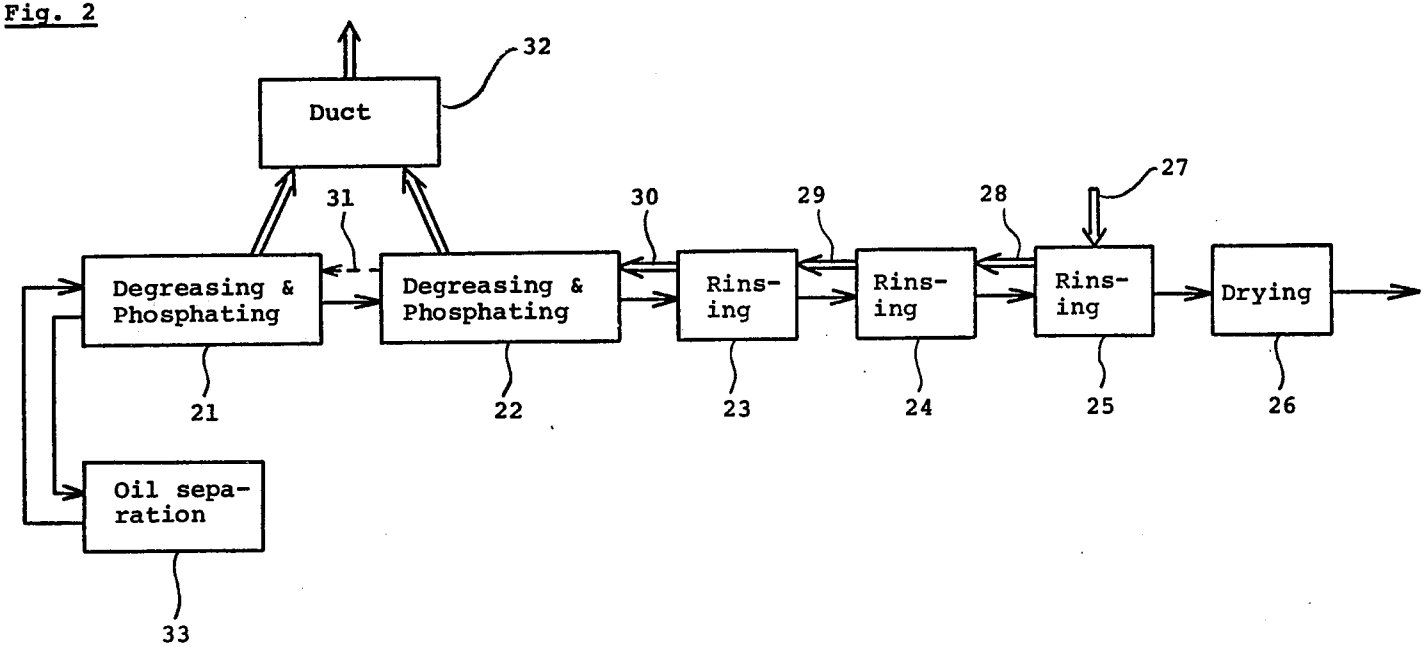

The present invention will be illustrated more in detail by the following Examples (wherein % is by weight) with reference to the accompanying drawings wherein:

FIG. 1 is a flow sheet showing an embodiment of the installation wherein the process of this invention is carried out; and FIG. 2 is a flow sheet showing another embodiment of the installation wherein the process of this invention is carried out.

EXAMPLE 1

In this Example, iron phosphating of cold-rolled steel plates is effected by the use of an installation of closed system (spray type) as shown in FIG. 1.

Each plate is first degreased at the degreasing step (1). Degreasing is carried out by spraying an aqueous solution containing a weakly alkaline degreasing agent (trade name "Lidolin No. 75N-4" manufactured by Nippon Paint Co., Ltd.) in a concentration of 1.5% on the plate at 55° C. for 1 minutes. The degreased plate is rinsed with water at the rinsing steps (2) and (3) and then introduced into the phosphating step (4).

In the phosphating step (4), a phosphating solution is sprayed onto the plate at a temperature of 50 to 55° C. for 1 minute, during which the treatment area is 30 $m^2$/hour. As the phosphating solution, there is used an aqueous solution (pH 5.6) comprising sodium ion, phosphate ion and m-nitrobenzenesulfonate ion respectively in concentrations of 0.12%, 0.43% and 0.05% and having a total acidity of 4.0 at the initial stage. In order to maintain the pH and the total acidity of the phosphate solution at the initial values during the treatment, an aqueous solution comprising sodium ion, phosphate ion and m-nitrobenzenesulfonate ion respectively in concentrations of 43 g/liter, 252 g/liter and 4.6 g/liter is occasionally supplied to the phosphating solution. The ion concentrations in the phosphating solution after the phosphating for 100 hours and 300 hours are as shown in Table 1.

The thus phosphated plate is rinsed with water at the rinsing steps (5), (6) and (7) in order and finally dried at the drying step (8). At the rinsing step (7), fresh water (9) is sprayed on the plate, under which a tank is located as a reservoir. The overflow (10) from this tank is sent to a tank as a reservoir at the rinsing step (6). The overflow (11) from this tank is then sent to a tank as a reservoir at the rinsing step (5). The overflow (12) from this tank is further sent to the tank at the phosphating step (4) where water in an amount substantially equal to that of the overflow (12) is vaporized and exhausted through the duct (13). The exhausted vapor is condensed by cooling, and the resulting water is used as fresh water in any rinsing step, usually as the fresh water (9).

The appearance of the plates as phosphated according to the above process is shown in Table 1, from which it is understood that the concentrations of various ions (except iron ions) in the phosphating solution are substantially unchanged even after the treatment for 300 hours. A slight increase of the iron ion concentration is seen, but it is not so serious as to impart an unfavorable influence to the resulting phosphate film.

Table 1

| | | | Phosphating | |
|---|---|---|---|---|
| | | Initial | After 100 hours | After 300 hours |
| Ion con-tra- | $Na^+$(%) | 0.12 | 0.12 | 0.13 |
| | 40 $PO_4^{3-}$(%) | 0.43 | 0.43 | 0.43 |

Table 1-continued

| | | Initial | Phosphating After 100 hours | Phosphating After 300 hours |
|---|---|---|---|---|
| centration | m-Nitrobenzenesulfonate ion* (%) | 0.05 | 0.048 | 0.051 |
| | Iron ion ($Fe^{2+}$, $Fe^{3+}$) (ppm) | 0 | 7 | 9 |
| Total acidity | | 4.0 | 4.0 | 4.0 |
| pH | | 5.6 | 5.6 | 5.6 |
| Appearance | | Uniform, reddish gold, excellent | Uniform, reddish gold, excellent | Uniform, reddish gold, excellent |

Note:
*The phosphating solution (10 ml) is taken out and, after addition of conc. HCl (5 ml) and Zn powder (0.5 g), heated in a water bath for 30 minutes to cause reduction. The mixture is filtered by the use of a filter paper, and the filtrate is titrated with a 1/40 N $NaNO_2$ solution using a potassium iodide-starch paper as an indicator.

Still, it may be noted that, in the installation as used in this Example, the drag-out or take-out of the phosphating solution from the phosphating step can be recovered and returned to the phosphating step without removal from the installation. This is quite advantageous in causing no environmental pollution problem. Further, since the evaporated water at the phosphating step can be condensed and reused as fresh water in the rinsing steps, the amount of water to be supplied to the installation is much decreased. This is meritorious from the economical viewpoint.

EXAMPLE 2

In this Example, iron phosphating of cold-rolled steel plates is effected by the use of an installation of closed system (spray type) as shown in FIG. 2.

Each plate is degreased and phosphated simultaneously at the phosphating (with degreasing) steps (21) and (22). Degreasing and phosphating are carried out by spraying a phosphating solution onto the plate at a temperature of 50° to 55° C. for 2 minutes, during which the treatment area is 30 $m^2$/hour. As the phosphating solution, there is used an aqueous solution (pH 5.6) comprising sodium ion, phosphate ion and m-nitrobenzenesulfonate ion respectively in concentrations of 0.12%, 0.43% and 0.05% as well as a surfactant mixture consisting of two non-ionic surface active agents (trade name "Emulgen 910" manufactured by Kao Soap Co., Ltd. and trade name "Pluronic 0-61" 61 manufactured by Asahi Denka Kogyo K.K.) in a concentration of 0.1% and having a total acidity of 4.0 at the initial stage. In order to maintain the pH and the total acidity of the phosphating solution at the initial values during the treatment, an aqueous solution comprising sodium ion, phosphate ion and m-nitrobenzenesulfonate ion respectively in concentrations of 43 g/liter, 252 g/liter and 4.6 g/liter as well as the said surfactant mixture in a concentration of 9.2 g/liter is occasionally supplied to the phosphating solution. The ion concentrations and the oil contents in the phosphating solution after the phosphating for 100 hours and 300 hours are as shown in Table 2.

The thus phosphated plate is rinsed with water at the rinsing steps (23), (24) and (25) in order and finally dried at the drying step (26). At the rinsing step (25), fresh water (27) is sprayed on the plate, under which a tank is located as a reservoir. The overflow (28) from this tank is sent to a tank as a reservoir at the rinsing step (24). The overflow (29) from this tank is sent to a tank as a reservoir at the rinsing step (23). The overflow (30) from this tank is further sent to a tank at the phosphating step (22). The phosphating solution is provided from a tank in the phosphating step (21) to the tank at the phosphating step (22), a portion (31) of the phosphating solution is returned from the latter to the former. At the phosphating steps (21) and (22), water in an amount substantially equal to that of the overflow (30) is vaporized and exhausted through the duct (32). The exhausted vapor is condensed by cooling, and the resulting water is used as fresh water in any rinsing step, usually as the fresh water (27). To the phosphating step (21), there is attached an oil separation step (33) where the phosphating solution is recycled to eliminate the oil component therefrom.

The appearance of the plates as phosphated according to the above process is shown in Table 2, from which it is understood that the concentrations of various ions (except iron ions) in the phosphating solution are substantially unchanged even after the treatment for 300 hours. Slight increases of the iron ion concentration, the surfactant mixture content and the oil content are seen, but those are not so serious as to impart an unfavorable influence to the resulting phosphate film.

Table 2

| | | Initial | Phosphating After 100 hours | Phosphating After 300 hours |
|---|---|---|---|---|
| Ion concentration | $Na^+$ (%) | 0.12 | 0.13 | 0.13 |
| | $PO_4^{3-}$ (%) | 0.43 | 0.43 | 0.44 |
| | m-Nitrobenzenesulfonate ion* (%) | 0.05 | 0.05 | 0.05 |
| | Iron ion ($Fe^{2+}$, $Fe^{3+}$) (ppm) | 0 | 10 | 11 |
| Surfactant mixture content | | 0.1 | 0.11 | 0.12 |
| Oil content* (%) | | 0.025 | 0.15 | 0.20 |
| Total acidity | | 4.0 | 4.0 | 4.1 |
| pH | | 5.6 | 5.6 | 5.6 |
| Appearance | | Uniform, reddish gold, excellent | Uniform, reddish gold, excellent | Uniform, reddish gold, excellent |

Note:
*The oil content was determined by extraction with n-hexane.

Still, it may be noted that, in the installation as used in this Example, the drag-out or take-out of the phosphating solution from the phosphating step can be recovered and returned to the phosphating step without removal from the installation. This is quite advantageous in causing no environmental pollution problem. Further, since the evaporated water at the phosphating step can be condensed and reused as fresh water in the rinsing steps, the amount of water to be supplied to the installation is much decreased. This is meritorious from the economical viewpoint.

COMPARATIVE EXAMPLE 1

In this Example, iron phosphating of a cold-rolled steel plate is effected by the use of an installation of closed system as shown in FIG. 1.

The phosphating process is carried out in the same manner as in Example 1 but using as the phosphating solution an aqueous solution (pH 5.6) comprising sodium ion, phosphate ion, citrate ion, pyrophosphate ion and bromate ion respectively in concentrations of 0.12%, 0.43%, 0.03%, 0.005% and 0.03% and having a total acidity of 4.2 at the initial stage and, in order to maintain the pH and the total acidity of the phosphate solution at the initial values, occasionally supplying to the phosphating solution an aqueous solution comprising sodium ion, phosphate ion, citrate ion, pyrophosphate ion and bromate ion respectively in concentrations of 44 g/liter, 252 g/liter, 2.5 g/liter, 5 g/liter and 5 g/liter.

After the phosphating for 100 hours and 300 hours, various concentrations in the phosphating solution are determined and shown in Table 3. The appearance of the phosphate film is observed, and the results are also shown in Table 3.

Table 3

| | | | Phosphating | |
|---|---|---|---|---|
| | | Initial | After 100 hours | After 300 hours |
| Ion concentration | $Na^+$ (%) | 0.12 | 0.12 | 0.12 |
| | $PO_4^{3-}$ (%) | 0.43 | 0.42 | 0.43 |
| | Citrate ion (%) | 0.03 | 0.03 | 0.03 |
| | Pyrophosphate ion (%) | 0.005 | 0.005 | 0.006 |
| | $BrO_3^-$ (%) | 0.03 | 0.03 | 0.03 |
| | $Br^-$ (%) | 0 | 0.05 | 0.15 |
| | Iron ion ($Fe^{2+}$, $Fe^{3+}$) (ppm) | 0 | 107 | 175 |
| Total acidity | | 4.2 | 5.7 | 5.6 |
| pH | | 5.6 | 5.7 | 5.6 |
| Appearance | | Uniform, blue, excellent | Yellowish blue, somewhat rust | Yellowish rust, powdery coating, bad |

From the above results, it is understood that, though a uniform, blue iron phosphate film is formed at the initial stage, the phosphate film becomes gradually defective with lapse of time, and powdery coating and yellow rust are observed after 300 hours. This is probably due to accumulation of bromine and iron ions, and replacement of the phosphating solution by a fresh one is necessary for eliminating such problem.

REFERENCE EXAMPLE 1

A steel plate is phosphated by the use of a phosphating solution as employed at the initial stage in Example 1 or 2 or comparative Example 1 or obtained after the employment in Example 1 or 2 or Comparative Example 1 for phosphating over a period of 100 or 300 hours. Then, the phosphated plate is coated with an epoxy-modified melamine alkyd resin composition for undercoating (trade name "Orga 1000-992-primer Surfacer" manufactured by Nippon Paint Co., Ltd.) and then with a melamine alkyd resin composition for surface coating (trade name "Orga 100-2-Blue" manufactured by Nippon Paint Co., Ltd.) to make a coating film of 40 microns in thickness after drying. The coating film is cross-cut and subjected to salt spray test for 120 hours. Then, an adhesive tape is adhered on the coating film under pressure and peeled off. The width (i.e. the length on one side) of the peeled off portion from the cross-cut part is shown in Table 4.

Table 4

| Phosphating solution | Initial | After 100 hours | (unit: mm) After 300 hours |
|---|---|---|---|
| Example 1 | 1.0 | 1.0 | 1.0 |
| Example 2 | 1.5 | 1.5 | 2.0 |
| Comparative Example 1 | 2.0 | 4–5 | 10 or more |

From the above results, it is apparent that, in Examples 1 and 2, the initial good performance can be practically maintained with the phosphating solution even after the use over a period of 300 hours, whereas such performance is greatly reduced in Comparative Example 1 after 100 hours and the whole surface is corroded by the use of such after 300 hours. In addition, it may be noted that the phosphating solutions in Examples 1 and 2 are superior to that of Comparative Example 1 even in the at the initial stage.

What is claimed is:

1. In a process for phosphating the surface of an iron substrate by treatment of the said surface with a phosphating solution in a closed system phosphating installation, the improvement wherein the phosphating solution is an aqueous solution consisting essentially of at least one of alkali metal and ammonium phosphates, in a concentration of from about 1 to 15 g/liter and at least one of aromatic nitro compounds capable of accelerating phosphating in a concentration of from about 1.05 to 5 g/liter in an aqueous medium and having a pH of about 3 to 6.5, and the process is performed at a temperature of from about 40° to 55° C.

2. The process according to claim 1, wherein the aqueous solution has a pH of about 5 to 6.

3. The process according to claim 1, wherein the total acidity in the aqueous solution is from about 2 to 30.

4. The process according to claim 1, wherein the aromatic nitro compound is a m-nitrobenzenesulfonate.

5. The process according to claim 1, wherein the aqueous solution further comprises at least one of nonionic and anionic surfactants.

6. The process according to claim 1 wherein said aromatic nitro compound is an m-nitrobenzenesulfonate, nitrobenzoic acid or nitroresorcinol.

7. The process according to claim 1 wherein the aromatic nitro compound is sodium m-nitrobenzenesulfonate.

* * * * *